US005566407A

United States Patent [19]

Lien

[11] Patent Number: 5,566,407

[45] Date of Patent: Oct. 22, 1996

[54] CRIB WITH AIR PERMEABLE SUPPORTING SURFACE

[76] Inventor: William W. Lien, 18888 NE. 116th, Redmond, Wash. 98052

[21] Appl. No.: 482,473

[22] Filed: Jun. 7, 1995

[51] Int. Cl.[6] ..... A47D 7/00; A47C 19/00

[52] U.S. Cl. ..... 5/93.1; 5/186.1; 5/655; 5/663; 5/922

[58] Field of Search ..... 5/655, 94, 93.1, 5/638, 186.1, 663, 922, 187, 190, 468, 461, 652

[56] References Cited

U.S. PATENT DOCUMENTS

| | | | |
|---|---|---|---|
| 504,443 | 9/1893 | Staab | 5/461 |
| 622,501 | 4/1899 | Larrabee | 5/643 |
| 1,382,531 | 6/1921 | Newborn | 5/900.5 |
| 1,736,341 | 11/1929 | Eiser | 5/463 |
| 2,581,802 | 1/1952 | Lyons | 5/643 |
| 2,695,415 | 11/1954 | Holton | 5/655 |
| 2,807,033 | 9/1957 | Austen . | |
| 2,836,833 | 6/1958 | Carlson | 5/655 |
| 2,924,832 | 2/1960 | Knowles | 5/606 |
| 3,135,974 | 6/1964 | Roman | 5/345 |
| 3,339,216 | 9/1967 | Ormerod | 5/347 |
| 3,814,030 | 6/1974 | Morgan, III | 108/51 |
| 3,837,019 | 9/1974 | Hoff | 5/93 |
| 3,949,435 | 4/1976 | Dionne | 5/630 |
| 4,188,678 | 2/1980 | Rawolle | 5/105 |
| 4,510,634 | 4/1985 | Diedrich et al. | 5/98 |
| 4,536,906 | 8/1985 | Varndell et al. | 5/468 |
| 5,406,655 | 4/1995 | Samlin | 5/655 |

FOREIGN PATENT DOCUMENTS

| | | | |
|---|---|---|---|
| 638046 | 5/1950 | United Kingdom | 5/643 |

*Primary Examiner*—Alexander Grosz
*Attorney, Agent, or Firm*—Roy E. Mattern, Jr.

[57] ABSTRACT

An infant's crib for newborn infants and infants beyond in age is made, whereby the infant will always have available breathing air, providing the infant with ample oxygen, and preventing the buildup of carbon dioxide exhausted by the infant, as this carbon dioxide is carried away by air circulating under the infant's crib. The infant is supported on permeable materials which in turn are supported on a crib frame. The permeable materials are positioned at a spaced distance over a supporting structure upon which portions of the crib frame are positioned. Preferably, two layers of permeable materials are used. The bottom permeable layer is strong enough to support the infant and has many openings per square inch. The top permeable layer, lying on the bottom permeable layer, is used to improve the comfort of the infant, and there are fewer openings per square inch. Both the top and bottom permeable layers are readily removed for cleaning. Preferably the head end of the infant's supporting permeable materials is supported at a higher level than the foot end, so when an infant is positioned on these permeable materials, which do stretch a small amount, his or her body is in a horizontal position, or a near horizontal position. The infant's head and upper body portions, which weigh more, stretch these supporting permeable materials sufficiently to require their head end to be initially higher than their foot end. This initial height difference serves to help allay any concern of excessive blood flow to the infant's cranial area.

16 Claims, 4 Drawing Sheets

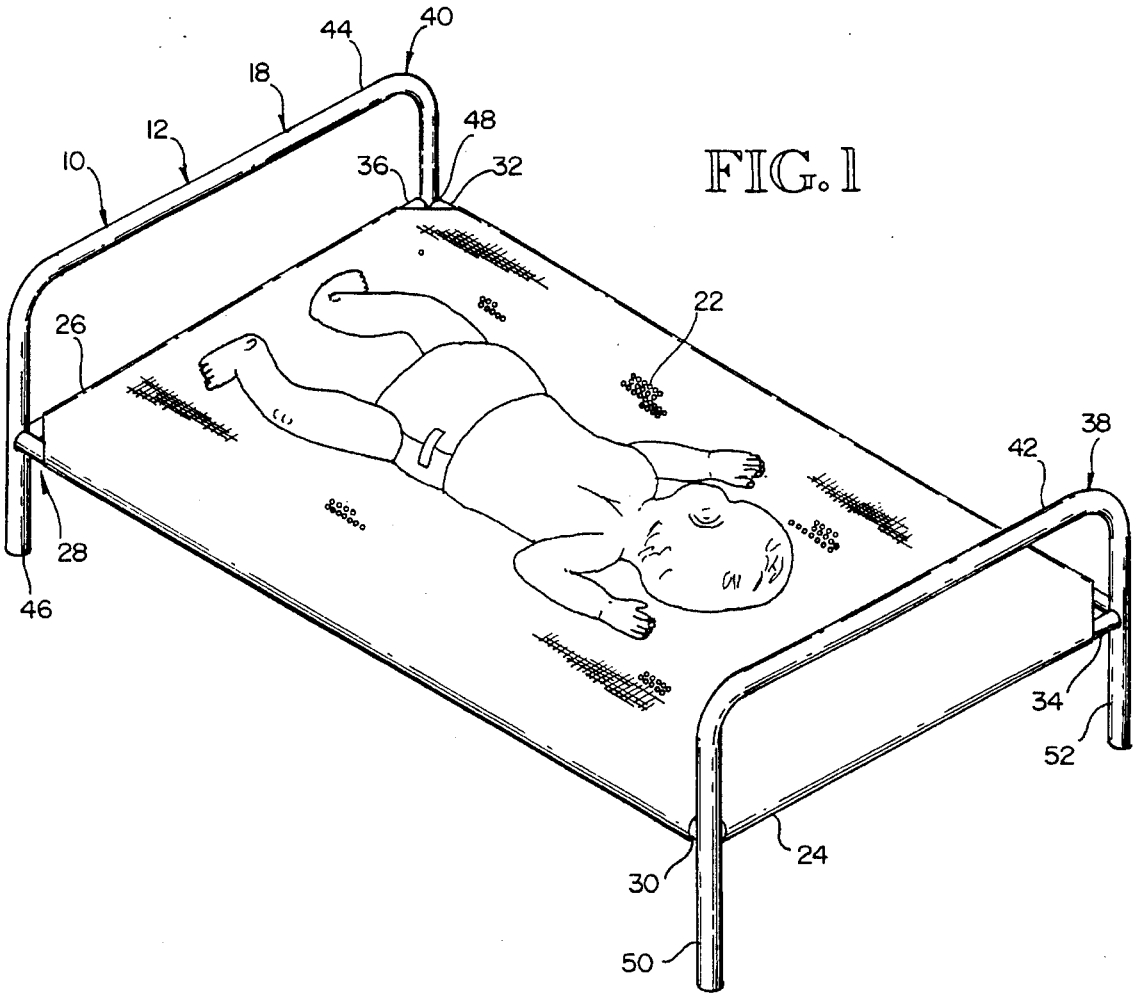
FIG. 1
FIG. 2
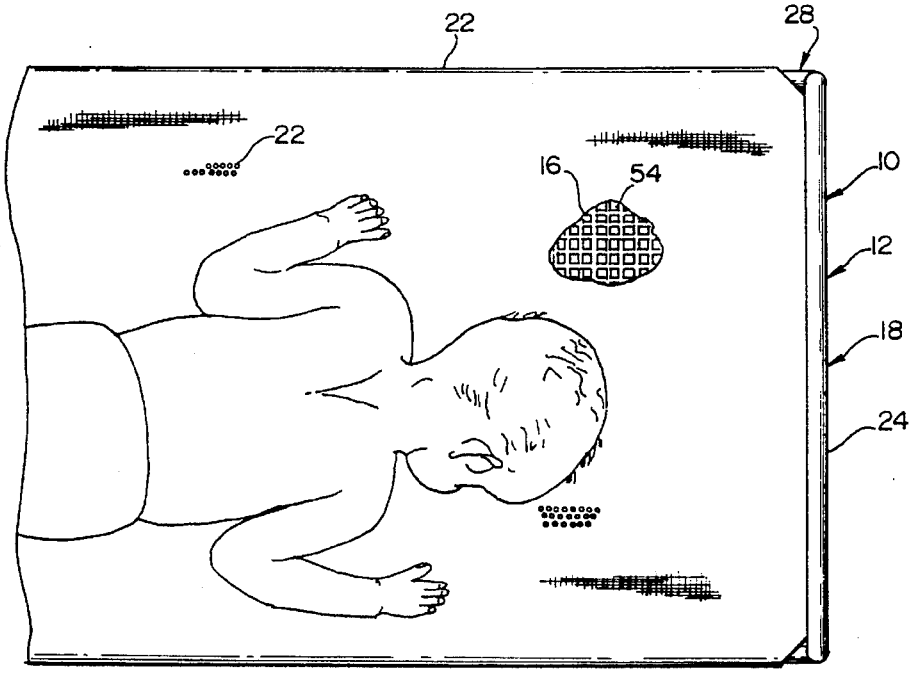

FIG. 8
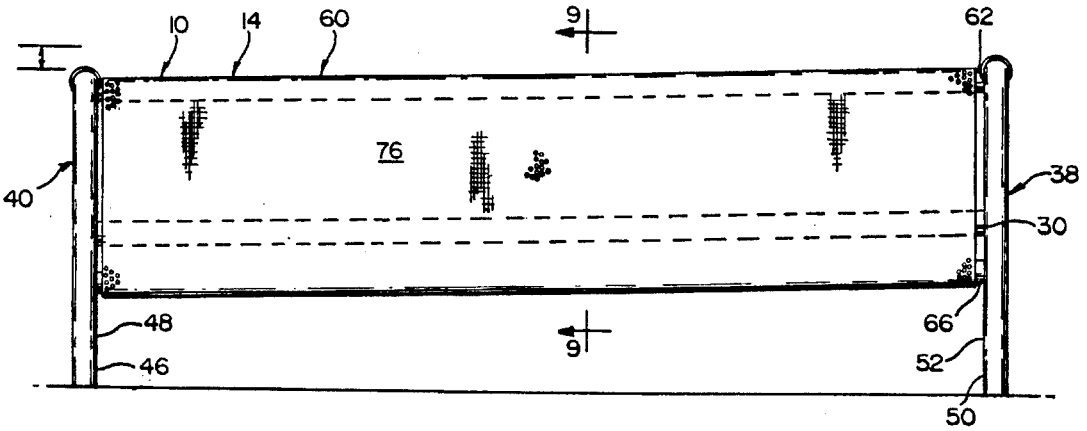
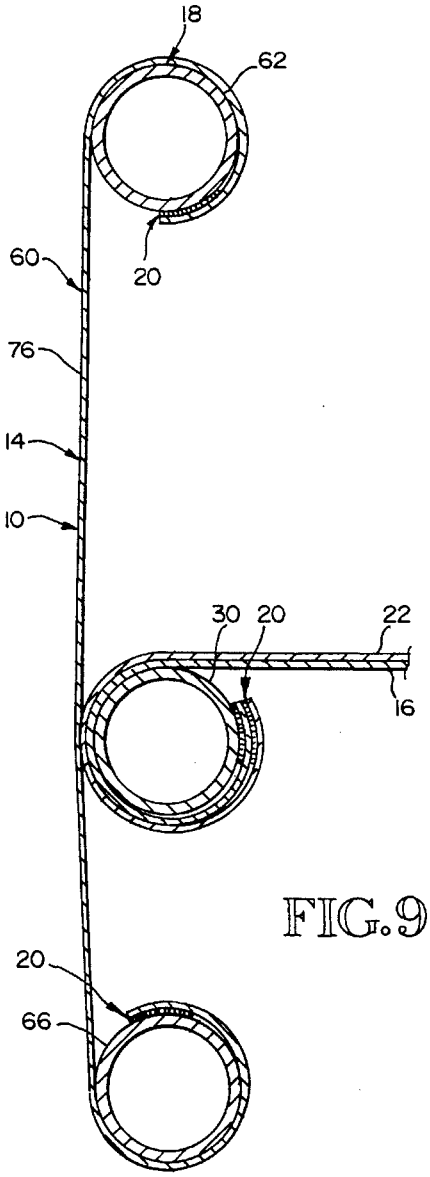
FIG. 9
FIG. 10
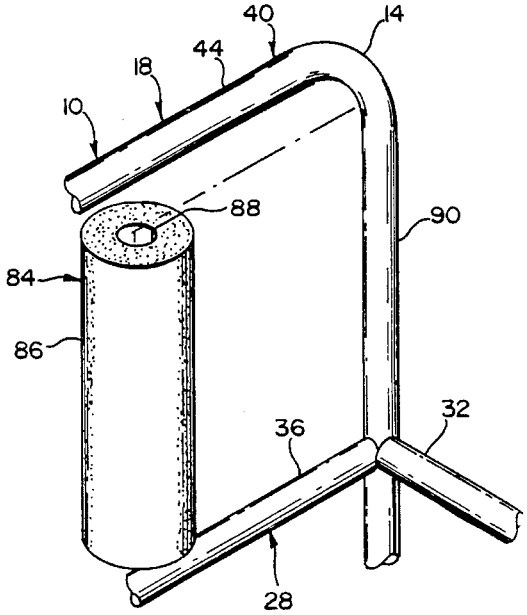

CRIB WITH AIR PERMEABLE SUPPORTING SURFACE

BACKGROUND

Baby beds and adult beds have been provided in the past to enable a baby or an adult to sleep with his or her chest and face resting directly downwardly on supporting materials, which are provided with air passageways through which breathing continues without suffocation.

In 1893 William Staab in his U.S. Pat. No. 504,443 illustrated and described his mattress which essentially was a complete bed specifically provided, in selected sizes, to provide for the drying of clothes of small children or sick persons, when their garments and possibly bed clothes become wet. By such drying, the annoyance and liability to possible chafing, or worse results, was removed. All the supporting materials which comprised his mattress were necessarily permeable. Mr. Staab was primarily concerned with draining liquids, but in doing so he provided throughout his so-called mattress, passageways for air.

In 1954, Francis C. Holton, in his U.S. Pat. No. 2,695,415, disclosed his mattress to be used particularly for infants. Mr. Holton realized that generally infants were placed on a conventional mattress which was or was not covered with an impervious material. In any case this covered mattress was further covered with a sheet and the infant was laid upon the sheet without a pillow. He then said "In most cases the infant's head becomes very warm as the head indents the mattress, whereas there is always some danger of smothering, when the infant may roll over and lie on its stomach. Furthermore, it is difficult to maintain the bed in a really sanitary condition, as an infant often tends to expel its food, with the result that the sheet must be changed, and the mattress washed, which presents substantial difficulty with conventional mattresses."

Mr. Holton therefore designed his mattress to include "a cushion-like body supporting section, and a relatively thin porous head supporting section, co-extensive therewith, with means for supporting the latter substantially in the plane of the upper surface of the body supporting section, and providing therebelow an air space."

Mr. Holton continued his description saying "Preferably, the head supporting section takes the form of a skeleton frame-work connected to the cushion-like body section of the mattress, and is designed to receive thereover a slip cover of thin porous material, such as muslin or the like, the intermediate portion of which, suspended between elements of the frame-work, forms the support for the head and/or upper portion of the torso."

Mr. Holton also said, "Preferably, also, the frame work provides an apron therebelow in vertical spaced relation to the head supporting section, the custom-like body supporting section of the mattress, and the apron being formed of an impervious washable material."

Mr. Holton said further, "that if the infant were to roll over on to its stomach so that its face was in direct contact with the head supporting element, the infant would be able to breathe reasonably through the porous covering, which would eliminate possibility of smothering, as in the case of a conventional mattress."

Moreover, Mr. Holton said expelled food and/or saliva, milk from a leaking bottle, or any other liquid will pass through the porous head support, avoiding unsanitary conditions, and the possibility of smothering of the child.

In 1957, Herman P. Austen, in his U.S. Pat. No. 2,807,033, illustrated and described his mattress having "openings of suitable size and shape to partially receive the face of a person lying on the mattress, while at the same time permitting the support on the person's head in a comfortable position." The openings were connected by horizontal transverse air channels. The person's face was supported so his or her nose and mouth extended into an opening, without coming into contact with the mattress. A person lying face down on Mr. Austen's mattress was assured of fresh circulating air for breathing purposes. When so lying down, he said, a person's throat and nasal tissues assume natural positions permitting easy breathing, thereby tending to eliminate snoring. He also said, it is well known that the digestive organs, and the heart function better, when one is lying on his or her stomach in a comfortable downwardly facing position, wherein breathing is not restricted or otherwise affected by a lack of fresh air. Although Mr. Austen indicated all of these advantages of the use of his mattress, he was apparently not concerned with the resting of an infant, but only with the sleeping of a grown person, who would be able to locate these limited mattress openings for intentionally positioning his or her face.

In 1964, Anthony P. Roman, in his U.S. Pat. No. 3,135, 974, illustrated and described his "face rest mattress" for persons who prefer to sleep in a prone or face down position to relieve certain abnormal strains and tensions of the body particularly in the neck and back. Mr. Roman also said his type of "face rest mattress" would be helpful in respect to infants. He said, "In addition, there have been many cases of infants requiring special prone positions for sleeping, but this is a situation fraught with danger, as the infant may spit up food and have difficulty in breathing. In cases like this, suffocation is an ever-present danger." Therefore the primary object of his invention was to provide a mattress for face down or prone sleeping wherein means was provided to allow free and normal breathing. At the head end of Mr Roman's "face rest mattress" he provided "a plurality of indentations or corrugations for air circulation, such as slots or grooves, spaced across the mattress and extending from the head of the mattress in the direction of the foot, to a distance equal to about 0.1 to 0.33 times the length of the mattress. Ordinarily the indentations varied from about 0.5 to 2.0 feet in length."

Mr. Roman also said, "If desired, the head end of the mattress containing the indentations may form an angle, such as from about 1 to thirty degrees, with the main body of the mattress, thereby enabling the head of the sleeper to be elevated with respect to his feet."

In 1967, George E. Ormerod, in his U.S. Pat. No. 3,339, 216, disclosed his "mattresses" which were made so if a child's or an invalid's face should "become pressed against the portion of the mattress for supporting the head, the risk of suffocation is greatly reduced." Mr. Ormerod's mattress comprises a "resilient pad of plastic material, having a series of perforations constituting air holes, extending only between the top and bottom surfaces of the pad at that part of the pad intended to support the head of the user." The remainder of the pad was imperforate. An air permeable sleeve, open at one end, was placed over the head-supporting part of the pad. An impermeable elastomeric sleeve, open at one end, was placed over the remaining part of the pad.

In 1985, Messrs. Varndell and Lawson, in their U.S. Pat. No. 4,536,906, illustrated and described their "mattress with apertured insert", for small children. Their mattress had "a removable foam insert", which fits "in an aperture cut in the head portion of a foam mattress body." The insert had a plurality of perforations extending from its top face to its bottom face", which reduced "the risk of suffocation". The perforations were "grouped towards the head of the mattress for optimum positioning beneath a child's head. When a child's head was positioned over the insert, and if the child buried its face in the mattress, then the passage of air through the insert reduced the danger of suffocation.

These prior inventions are all recognized for their merit. However, there remains a need for an infant's crib to receive an infant from the time of his or her birth and up to six months of his or her age, to combat any possibility of sudden infant death syndrome, commonly referred to as sids. Such a crib will insure that an infant will always have breathing air providing him or her with ample oxygen, wherever the infant may be located in the infant's crib.

SUMMARY

In spite of many directives, warnings, and research projects concerning the care of infants and especially of newborn infants, there continue to be mysterious fatalities of infants attributed to what is termed sudden infant death syndrome, referred to briefly as SIDS. It is also sometimes called crib death, and the infants that die range in age from newborn to one year.

Most infants spontaneously tend to sleep face down and often successfully try to do so. When infants are in a face down position, their inspired carbon dioxide is known to be three times greater when they are resting on soft bedding rather than resting on hard bedding. Many doctors practicing pediatric medicine would prefer that an infant be placed with his or her chest on the supporting surface. However, the fear of SIDS, results in many doctors advising parents to lay their infant with his or her back on the supporting surface.

Therefore, to insure a newborn infant and an infant beyond in age will always have available breathing air, providing the infant with ample oxygen, an infant's crib for newborn infants, and infants beyond in age, has the overall resting and supporting portion of the crib made of permeable materials. Wherever the infant may be initially placed and wherever the infant may move, there will be openings available through which fluid will pass. Any possibility of the infant's breathing becoming ineffective because of blocking fluids is eliminated. There will not be a build up of carbon dioxide or liquids.

These supporting materials, via utilization of supporting and positioning members of an overall frame, are always positioned sufficiently above a surface structure, upon which leg portions of the overall frame are positioned, whereby the air circulating in an infant's sleeping area flows readily below and above these supporting permeable materials.

The supporting permeable materials undergo a limited stretching when an infant is resting on them. Therefore, preferably, the overall frame is arranged so the head of the infant's crib is higher than the foot thereof. Then when the infant is resting, his or her body on these supporting permeable materials with his or her head nearer the head of the infant's crib, his or her body is level or near level, allaying any concern of an excessive blood flow to the infant's cranial area.

The frame members may be increased to provide support for optional surrounding permeable sides and ends, which insure an infant will remain well positioned on the supporting permeable materials. The frame members may also be arranged to provide hand holding places, when an adult moves this infant's crib, with or without the infant being supported thereon.

Preferably, two layers of supporting permeable materials are used. The bottom permeable layer is strong enough to support the infant and it has many openings per square inch. The top permeable layer, lying on the bottom permeable layer, is used to improve the comfort of the infant, and it has fewer openings per square inch. These layers are readily removed for cleaning.

The openings of these permeable materials and the positioning of these permeable materials insure that the infant will always have adequate circulating room air about her or him, and they therefore will have an adequate supply of oxygen during their resting times.

DRAWINGS

Infants' cribs for newborn infants and infants beyond in age, that insure an infant will always have available breathing air providing the infant with ample oxygen, and preventing any buildup up of carbon dioxide, which is carried away by air circulating under the infant's crib, are illustrated in the figures of drawings, wherein:

FIG. 1 is a perspective view of a basic embodiment of an infant's crib showing the infant resting in one of an infant's preferred positions, when his or her chest is resting on supporting materials, through which air flows, and which are positioned above the supporting structure on which the infant's crib is placed;

FIG. 2 is a partial top view of the infant's crib shown in FIG. 1, illustrating the permeable layers of supporting materials upon which the infant is resting, with the broken away area of the comfortable top permeable layer, exposing the stronger supporting bottom permeable layer;

Figure 3:
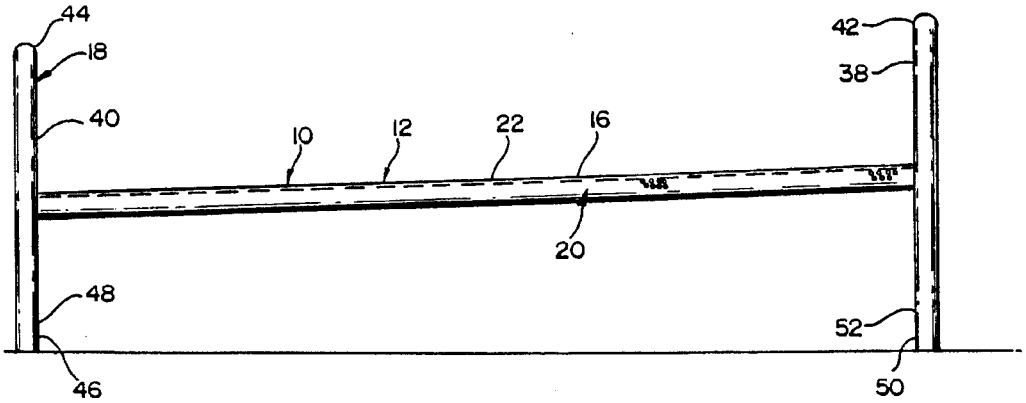
Figure 4:
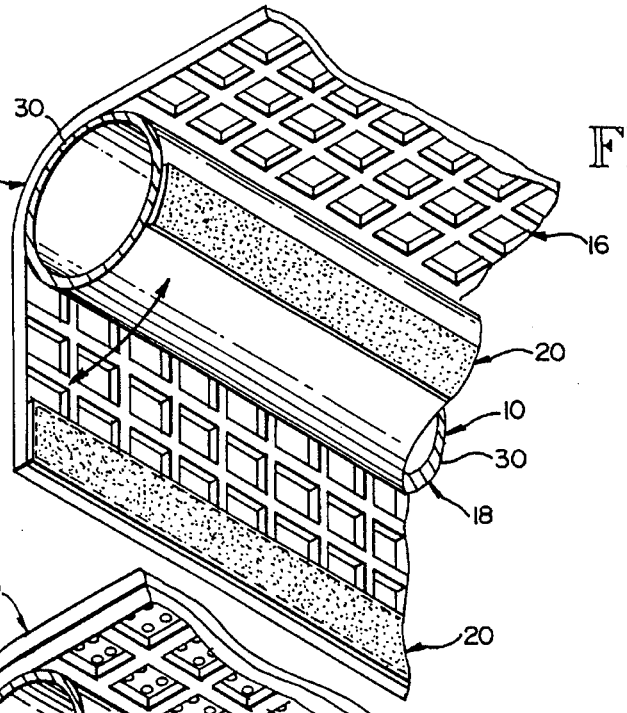
Figure 5:
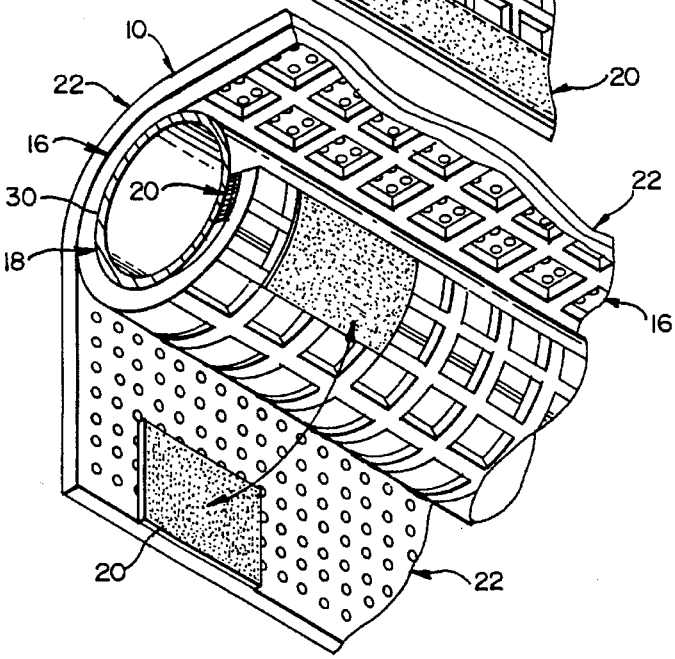
Figure 6:
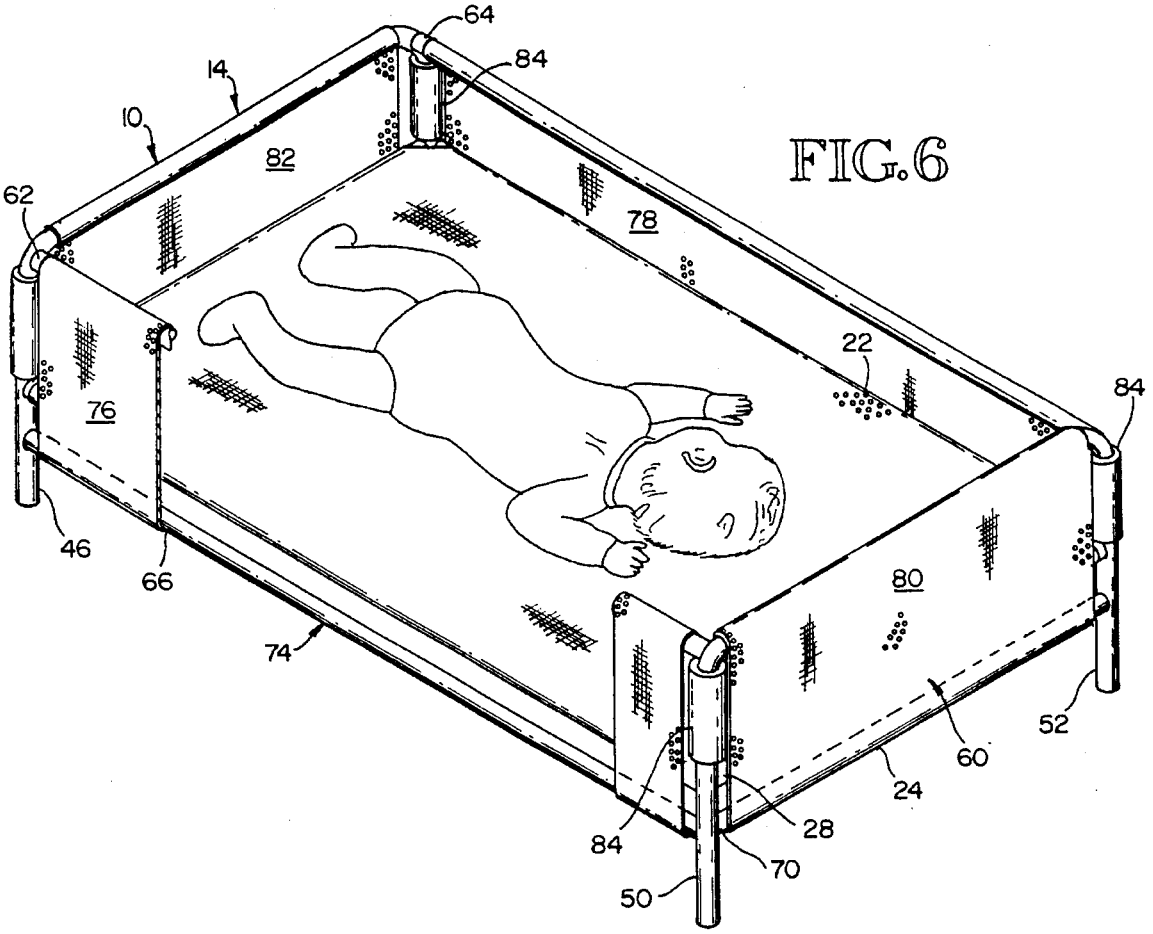
Figure 7:
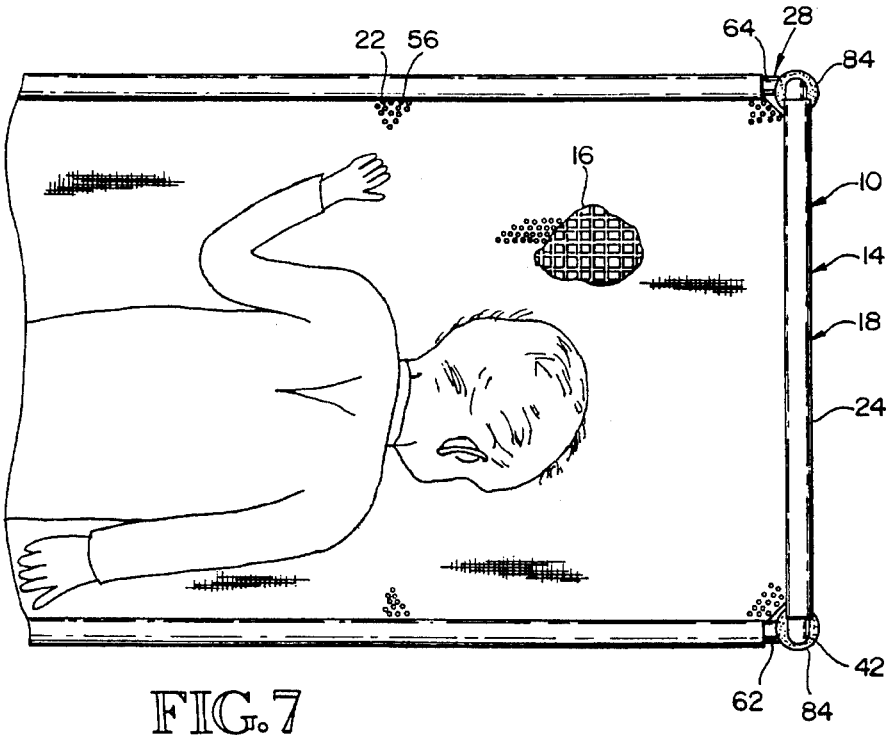

FIG. 3 is a side view of the infant's crib shown in FIGS. 1 and 2, illustrating how the frame of the infant's crib, positions the permeable layers of supporting materials in a starting planar position, wherein the head portions, i.e. anterior, of the bed, are higher than the foot portions, i.e. posterior, of the bed, whereby later, when an infant is positioned on these supporting materials, they will, in part, change in their contour, during a small amount of stretching, to support the infant in a level or near level position, thereby compensating for the heavier weight upper body. i.e. thorax, and head portions of the infant, and allaying the possibility of excessive blood flow to the infant's head, i.e. cranial portions thereof;

FIG. 4 is a partial perspective view to illustrate how the stronger supporting bottom permeable layer of material is supported by securing the outer edges thereof to respective main members of the frame of this infant's crib, shown in FIGS. 1, 2, and 3, and the securing fasteners illustrated are hook and loop fasteners;

FIG. 5 is a partial perspective view to illustrate how the comfortable top permeable layer of material, after the fastening of the stronger supporting bottom permeable layer, is supported by securing the outer edges thereof, at spaced locations, to this stronger supporting bottom permeable layer of the infant's crib, shown in FIGS. 1, 2, 3 and 4, and the securing fasteners illustrated are hook and loop fasteners;

FIG. 6 is a perspective view of an infant's crib having additional components, which are added to the basic embodiment shown in FIGS. 1 through 5, and these include additional members of the frame, used primarily to support permeable upstanding sides and ends which restrict an infant in his or her movements, so the infant remains over and on the supporting permeable materials, and where necessary the frame is padded;

FIG. 7 is a partial top view, similar to FIG. 2, showing, in addition to the supporting permeable members, upon which the infant is resting, the top rail portions of the frame which support the permeable upstanding sides and ends, which insure the infant will remain over and on the supporting permeable materials, and also showing where padding is used at the corners of this infant's crib to cover the otherwise exposed portions of the frame;

FIG. 8 is a side view, similar to FIG. 3, showing, in addition to the original frame members, top rail frame members supporting the permeable upstanding sides and ends, which keep an infant over and on the supporting permeable materials, and also extra bottom frame members spaced just below the main frame members shown in FIGS. 1 through 5 to which the permeable layers of supporting materials are fastened; whereby these extra bottom frame members are used in securing the lower edge portions of the permeable upstanding sides and ends;

FIG. 9 is a partial sectional view taken in reference to line 9—9, shown in FIG. 8, to illustrate how a top rail frame member, a main frame member, and a bottom frame member, are utilized during the securement of the edge portions of the respective permeable materials, and the fasteners shown are hook and loop fasteners, and specifically indicating how the two layers of permeable supporting materials are secured to the main frame member, as also shown in FIGS. 4 and 5, and how the permeable upstanding sides and ends are secured at their top edge portions, with hook and loop fasteners, to the top rail frame members, and are secured at their bottom edge portions, with hook and loop fasteners, to the extra bottom frame members; and FIG. 10 is a partial perspective view of a corner portion of the overall frame, shown in FIGS. 6 through 8, to illustrate how any portion of the frame which remains exposed, is covered by padding, thereby avoiding any possible injury to an infant, and the installed padding is illustrated in FIGS. 6 through 8.

DESCRIPTION OF THE PREFERRED EMBODIMENTS

Introduction

Two preferred embodiments of an infant's crib 10 for newborn infants and infants beyond in age are illustrated in the drawings. In FIGS. 1 through 5, a basic newborn infant's crib 12 is illustrated. Then in FIGS. 6 through 9 an infant's crib 14 is illustrated, which has added components to enhance the safety of a newborn infant placed in his or her crib, insuring the newborn infant will remain over the two supporting layers of permeable materials.

These two layers are used together in the same way in both embodiments. The lower layer 16 is the strong supporting layer, which by itself can support the infant, when this layer in turn is first secured about its respective edges to a frame assembly 18. Several types of fasteners may be used to secure these edges, and the use of hook and loop fasteners 20 is illustrated. The upper layer 22 is the comfortable layer, which by itself does not fully support an infant well enough.

Preferably, when an infant is placed on these two layers, he or she will be resting in a level or near level position. To insure this positioning, preferably one end portion of this newborn infant's crib 10 will be slightly higher than the other end. Then the heavier portions of the infant will be positioned near the higher end 24, and the lighter portions of the infant will be positioned nearer the lower end 26.

Preferably, the infant will be adequately kept warm enough by wearing his or her own garments, and no covers will be used. Then at all times the infant will be able to successfully breathe, as the surrounding air freely flows down, up, and/or around the infant. If a cover is used, the infant will always be able to breathe by having access to the air circulating under this infant's crib, via the multiple openings of the respective two supporting layers of permeable materials. Any possible serious build up of carbon dioxide will be avoided, because carbon dioxide will be carried away by air circulating under the infant's crib. Also any liquids will drain down through the permeable materials, so there will be no danger of liquids blocking the circulation of air about an infant. When an infant rests and sleeps in a respective embodiment of this infant crib 10, he or she will live beyond the troublesome first weeks and often months beyond his or her birth, when other infants resting on non-permeable supports have been known not to breathe sufficiently, sometimes resulting in their unexpected deaths.

The Basic Newborn Infant's Crib

The basic newborn infant's crib 12, as shown in FIGS. 1, 2, 3, 4, and 5, has a planar frame 28, preferably arranged in a rectangular configuration with spaced longitudinal parallel sides 30, 32 and spaced transverse parallel ends 34, 36, with end 34 being referred to as the head end 34, and with end 36 being referred to as the foot end 36. Preferably, this planar frame 28 is supported by a vertically arranged head end frame 38, and a vertically arranged foot end frame 40. Both of these frames 38, 40 extend above the planar frame 28 to provide respective cross bars 42, 44 for hand gripping when the infant's crib 10 is carried with or without the infant resting on the two supporting layers of permeable materials 16 and 22.

In reference to a specific embodiment of this basic newborn infant's crib 12, the frame assembly 18 is preferably made of one inch diameter aluminum tube, having a chip-proof resistant finish. The spaced longitudinal parallel sides 30, 32 are thirty inches long. The spaced transverse parallel ends 34, 36 are eighteen inches wide. The vertically arranged head end frame 38 is secured to the planar frame 28 to place the head end 34 of the planar frame 28 four inches above a supporting structure, upon which the newborn infant's crib is placed. The vertically arranged foot end frame 40 is secured to the planar frame 28 to place the foot end 36 of the planar frame 28 three inches above a supporting structure, upon which the newborn infant's crib is placed. Therefore in this specific embodiment the head end of the planar frame 28 is one inch higher than foot end of the planar frame 28, and the rear legs 46, 48 are three inches high, and the front legs 50, 52 are four inches high in respect to the frame assembly 18.

Continuing in reference to a specific embodiment, and in respect to the two supporting layers of permeable materials, the lower supporting layer 16 is made of polyester, which is coated with a natural latex based compound, having, in turn, a softening agent. In reference to a square inch of this stronger supporting layer, there are thirty rectangular openings, or open spaces 54 through which circulating air may readily pass. Preferably, this lower supporting layer is removably and firmly attached, along the four edges thereof, to the planar frame 28, utilizing throughout, preferably hook and loop fasteners 20 as shown in FIG. 4. This lower supporting layer 16 is removed periodically for cleaning, and as necessary, eventually for replacement.

Continuing in reference to a specific embodiment, and in respect to the upper supporting layer 22 of the two supporting layers of permeable materials, a washable cotton cloth is arranged for attachment at spaced locations to the edges of the lower supporting layer 16, preferably using hook and loop fasteners 20, as illustrated in FIG. 5. In reference to a square inch of this upper supporting layer 22, there are sixteen near circular openings or open spaces 56. This upper supporting layer 22, which is soft and comfortable for the infant to lie on, is easily removed for cleaning and washing. Extra upper supporting layers 22 will preferably be available for quick changes when a particular one, then in use, one becomes soiled.

The Newborn Infant's Crib With Added Components

To enhance the safety of an infant placed in his or her infant crib, especially insuring an infant will remain over the two supporting layers of permeable materials 16, 22, and also insuring the infant, during any possible movements, will not directly contact the frame assembly 18, components are added to the basic newborn infant's crib 12, as shown in FIGS. 6, 7, 8, 9 and 10, to provide the newborn infant's crib 10 in the embodiment 14, having these added components.

To keep the infant located over the two supporting layers of permeable materials 16, 22, a surrounding containment barrier 60 is removably added, preferably by using hook and loop fasteners 20. This barrier 60 also is a permeable material, i.e. a mesh material, made of plastic and strong enough to restrain a moving infant without causing any entanglements. Preferably this barrier 60 is three inches high.

To create a better support for this surrounding containment barrier 60, additional frame members are added to the frame assembly 18. Top longitudinal rails 62, 64 are arranged directly above and parallel, respectively, to the spaced longitudinal sides 30, 32 of the planar frame 28. Also bottom longitudinal rails 66, 68 are arranged directly below and parallel, respectively, to the spaced longitudinal sides 30, 32 of the planar frame 28. In addition, bottom transverse rails 70, 72 are arranged directly below the spaced transverse ends 34, 36 of the planar frame. The lower positioning is the same for both the bottom longitudinal rails 66, 68, and the bottom transverse rails 70, 72. Therefore, they, as a group, in a rectangular configuration, form another planar frame 74 which is called a securement frame 74.

The surrounding containment barrier 60, as illustrated in FIGS. 6, 7, and 8, is in four parts. There are two longitudinal parts 76, 78, and two transverse parts 80, 82. In respect to each of these parts, they are secured at their top portions to the respective top longitudinal rails 62, 64, or the hand gripping cross bars 42, 44, and they are secured at their bottom positions to the respective bottom longitudinal rails 66, 68 on the bottom transverse rails 70, 72.

How the surrounding containment barrier 60, and the two supporting layers of permeable materials 16, 22, are arranged and secured in this embodiment 14, having the added components, and preferably using hook and loop fasteners, is illustrated, in part, in FIG. 9, in respect to one longitudinal side of the newborn infant's crib 10. The surrounding containment barrier 60 at the longitudinal part 76 is secured above to the top longitudinal rail 62, and is secured below to the bottom longitudinal rail 66. The lower supporting layer 16 of the permeable material is secured to the spaced longitudinal side 30 of the planar frame 28. The upper supporting layer 22 of the permeable material is secured to lower supporting layer 16, at spaced locations, where this upper supporting layer 22 is secured essentially continuously to the spaced longitudinal side 30 of the planar frame 28. The surrounding containment barrier 60 is tightly secured so no gap is formed or ever forms as this barrier 60 extends past the planar frame 28.

To continue the safety precautions, padding 84 is placed over any otherwise exposed portions of the frame assembly 18. As illustrated in FIG. 10, a foam rubber padding, at least one eighth of an inch thick, arranged in a hollow cylinder 86, having a longitudinal slit 88, is preferably arranged about an otherwise exposed portion 90 of the frame assembly 18, wherever such an exposed portion 90 is, which the infant could otherwise directly contact during his or her possible movement.

Other Possible Embodiments

In all embodiments, the important consideration is to support the infant so she or he will be able to breathe without the danger of suffocation. Any possible serious build up of carbon dioxide will be avoided, because carbon dioxide is carried away by air circulating under the infant's crib. Also any liquids will drain down through the permeable materials, so there will be no danger of liquids blocking the circulation of air about the infant. The entire supporting area must be composed of permeable material. To acquire both the support needed and the comfort needed, the selection of materials currently requires the two layers of supporting permeable materials. In the future one layer might be fabricated from a material, yet to be developed, to then become both the supporting and comfortable permeable material.

Although the rectangular frame configuration is preferred, other configurations could be used providing the supporting materials are sufficiently held in their useful positions. Aluminum tubing is selected as the preferred structural material. However, other structural materials might be used in providing the frame assembly. Whatever choices are made in providing this newborn infant's crib 10, the objective is to completely eliminate any death of an infant that otherwise might be attributed to the lack of good circulating breathing air.

I claim:

1. An infant's crib for newborn infants and infants beyond in age, whereby the infant will always have available breathing air providing the infant with ample oxygen, and preventing the build up of carbon dioxide, which is carried away by air circulating under the infant's crib, comprising:

a. a frame for placement in part on a supporting surface and having, at a level above the supporting surface, spaced members thereof, arranged in a plane, and adapted to receive and to hold permeable materials extending between these spaced members, upon which an infant may be supported, often being face down;

b. a lower positioned permeable material of a first, higher permeability extended between the spaced members of the frame and held by them to serve as the infant's supporting permeable material; and c. an upper positioned permeable material of a second, lower permeability, removable placed over the lower permeable material and also extended between the spaced members of the frame and held by them to serve as the infant's direct resting surface material, said upper positioned material being soft and gentle to the infant's skin.

2. An infant's crib, as claimed in claim 1, wherein the spaced members of the frame arranged in a plane are positioned relative to the supporting surface to make the anterior of this plane of the crib higher than the posterior thereof, whereby the heaviest portions of an infant, which are the head and thorax, when being supported by the lower positioned permeable material, at the crib's anterior, which is arranged purposely to have a small amount of stretch, are held so the infant is positioned in a near level position, allaying any concern of excessive blood flow to the infant's cranial area.

3. An infant's crib, as claimed in claim 2, wherein the anterior of this plane of the crib is one inch higher than the posterior thereof.

4. An infant's crib, as claimed in claim 1, wherein the frame also has upstanding spaced members, about which upstanding permeable material is positioned and so held to be a barrier to keep an infant positioned over the upper and lower permeable materials.

5. An infant's crib, as claimed in claim 4, having padding covering frame portions, whereby any possible otherwise direct contact of the frame by an infant is avoided, because the possible first contact will be made against the padding covering a frame portion.

6. An infant's crib, as claimed in claim 4, wherein the frame has additional spaced members arranged in a plane parallel to the plane and below the plane of spaced members adapted to receive and to hold permeable materials extending between these spaced members, and these lower positioned spaced members arranged in the parallel plane receive and secure the upstanding permeable material at the bottom thereof.

7. An infant's crib, as claimed in claim 6, having hook and loop fasteners that secure the upstanding permeable material at the bottom thereof to the lower positioned spaced members, arranged in the parallel plane.

8. An infant's crib, as claimed in claim 7, wherein the upstanding spaced members of the frame, in supporting the spaced members thereof, which are arranged in a plane, position them so their plane's anterior end is higher than the posterior end thereof, whereby the heaviest portions of an infant, which are the head and thorax, when being supported by the lower positioned permeable material at the crib's anterior, which is arranged purposely to have a small amount of stretch, are held so the infant is positioned in a level position, allaying any concern of excessive blood flow to the infant's cranial area.

9. An infant's crib, as claimed in claim 1, wherein the lower positioned permeable material has thirty openings per square inch.

10. An infant's crib, as claimed in claim 1, wherein the upper positioned permeable material has sixteen openings per square inch.

11. An infant's crib, as claimed in claim 1, wherein the lower positioned permeable material has thirty openings per square inch, and wherein the upper positioned permeable material has sixteen openings per square inch.

12. An infant's crib, as claimed in claim 11, wherein the spaced members of the frame arranged in a plane are positioned relative to the supporting surface to make the anterior of this plane higher than the posterior thereof, whereby the heaviest portions of an infant, which are the head and thorax, when being supported by the lower positioned permeable material, at the crib's anterior, which is arranged purposely to have a small amount of stretch, are held so the infant is positioned in a level position, allaying any concern of excessive blood flow to the infant's cranial area.

13. An infant's crib, as claimed in claim 12, wherein the anterior of this plane is one inch higher than the posterior thereof.

14. An infant's crib, as claimed in claim 12, wherein the frame also has upstanding spaced members, about which upstanding permeable material is positioned and so held to be a barrier to keep an infant positioned over the upper and lower permeable materials.

15. An infant's crib, as claimed in claim 14, having hook and loop fasteners to secure all the permeable materials to the frame and to themselves.

16. An infant's crib, as claimed in claim 15, having padding covering selected frame portions, whereby any possible otherwise direct contact of the frame by an infant is avoided, because the possible first contact will be made against the padding covering a frame portion.

* * * * *